US011145479B2

(12) United States Patent
Burkett et al.

(10) Patent No.: US 11,145,479 B2
(45) Date of Patent: Oct. 12, 2021

(54) ELECTRICAL SWITCHGEAR

(71) Applicant: Eaton Intelligent Power Limited, Dublin (IE)

(72) Inventors: Roger Burkett, Swindon (GB); Asad Mujawar, Kolhapur (IN); Anindita Sarma, Assam (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/971,323

(22) PCT Filed: Feb. 14, 2019

(86) PCT No.: PCT/EP2019/053624
§ 371 (c)(1),
(2) Date: Aug. 20, 2020

(87) PCT Pub. No.: WO2019/162173
PCT Pub. Date: Aug. 29, 2019

(65) Prior Publication Data

US 2021/0098221 A1 Apr. 1, 2021

(30) Foreign Application Priority Data

Feb. 23, 2018 (IN) ..... 201811007019
Apr. 10, 2018 (GB) ..... 1805920

(51) Int. Cl.
*H01H 71/56* (2006.01)
*H01H 1/20* (2006.01)
(Continued)

(52) U.S. Cl.
CPC ..... *H01H 71/56* (2013.01); *H01H 1/2083* (2013.01); *H01H 3/40* (2013.01);
(Continued)

(58) Field of Classification Search
CPC ..... H01H 71/56; H01H 1/2083; H01H 3/40; H01H 11/0018
(Continued)

(56) References Cited

U.S. PATENT DOCUMENTS 4,472,701 A * 9/1984 Bellows ..... H01H 73/04 200/243
8,138,862 B2 * 3/2012 Mueller ..... H01H 73/045 335/172
(Continued)

FOREIGN PATENT DOCUMENTS

CN 103762103 A 4/2014
DE 102011086172 A1 5/2012
(Continued)

*Primary Examiner* — Edwin A. Leon
*Assistant Examiner* — Iman Malakooti
(74) *Attorney, Agent, or Firm* — Leydig, Voit & Mayer, Ltd.

(57) ABSTRACT

An electrical switchgear includes: a housing; at least one first contact mounted in the housing; at least one second contact translationally movable within the housing in a translational movement direction; a switchgear control mechanism having a first rotary element having a first rotation axis and a second rotary element having a second rotation axis; and a link element pivoted on one end thereof to the first rotary element and on an other end thereof to the at least one second contact. The first and the second rotation axes are arranged substantially perpendicular to each other. The second rotation axis is arranged essentially in parallel to the translational movement direction of the at least one second contact. The first and the second rotary elements engage such that a rotation of the second rotary element is transmitted to the first rotary element.

6 Claims, 4 Drawing Sheets

(51) Int. Cl.
*H01H 3/40* (2006.01)
*H01H 11/00* (2006.01)

(52) U.S. Cl.
CPC . *H01H 11/0018* (2013.01); *H01H 2011/0025* (2013.01); *H01H 2071/565* (2013.01)

(58) Field of Classification Search
USPC ..... 200/243, 329
See application file for complete search history.

(56) References Cited

U.S. PATENT DOCUMENTS

| | | | | |
|---|---|---|---|---|
| 2005/0133352 | A1* | 6/2005 | Shin ..... | H01H 71/56 200/330 |
| 2006/0070862 | A1 | 4/2006 | Dumont | |

FOREIGN PATENT DOCUMENTS

| | | | | |
|---|---|---|---|---|
| EP | 0496213 | A1 * | 7/1992 | ..... H01H 1/20 |
| EP | 0496213 | A1 | 7/1992 | |
| GB | 662344 | A | 12/1951 | |
| WO | WO 2012080250 | A1 | 6/2012 | |
| WO | WO 2016165054 | A1 | 10/2016 | |

* cited by examiner

ELECTRICAL SWITCHGEAR

CROSS-REFERENCE TO PRIOR APPLICATIONS

This application is a U.S. National Phase application under 35 U.S.C. § 371 of International Application No. PCT/EP2019/053624, filed on Feb. 14, 2019, and claims benefit to Indian Patent Application Publication No. IN 2018/11007019, filed on Feb. 23, 2018, and to British Patent Application No. GB 1805920.4, filed on Apr. 10, 2018. The International Application was published in English on Aug. 29, 2019 as WO 2019/162173 under PCT Article 21(2).

FIELD

This specification relates to an electrical switchgear with different modes of operation.

BACKGROUND

Conventional electrical switchgears such as the DMM 40A electrical switchgear from Eaton Corp. usually have only a front rotary operation mode. Auxiliary contacts can be operated only with handles having an extension. The electrical switchgear Sirco M 16A from SOCOMEC has a front and a side rotary operation mode. The side rotary operation mode allows to mount the switchgear in places, where the front operation mode is not accessible. The switchgear can then be operated via the side operation mode.

The international patent application WO2012/080250A1 discloses an electrical switchgear having a rotary drive, which can be retrofitted. The rotary drive allows to operate the switchgear from the front and the side in a rotary manner, while the switchgear comprises an operator control element which can be moved in a substantially translationally manner. The switchgear is provided with a holder for the rotary drive so that the rotary drive can be integrated in the switchgear.

The European patent application EP 0 496 213 A1 relates to a circuit breaker with at least one fuse link, with a line supplying the current thereto and a line carrying the current away from it, each line having two fixedly arranged contact tracks which are separated from one another and with which two movable contact bridges are associated, which in their switched-on position make diametrical contact with the respective contact track, the contact bridges being received by at least one actuating slide. In order to ensure optimum switching and operating behavior of the circuit breaker with a structurally flat design, it is proposed in accordance with the invention that two actuating slides arranged parallel to one another are provided, which can be moved in opposite directions by means of a switching mechanism, the contact tracks being arranged perpendicularly to the direction of movement of the actuating slides and each actuating slide accommodates a contact bridge with axial play parallel to the contact tracks assigned to the respective line, the contact bridges connecting the assigned contact tracks to one another under spring pretension in their switched-on positions.

SUMMARY

In an embodiment, the present invention provides an electrical switchgear, comprising: a housing; at least one first contact mounted in the housing; at least one second contact translationally movable within the housing in a translational movement direction; a switchgear control mechanism comprising a first rotary element having a first rotation axis and a second rotary element having a second rotation axis; and a link element pivoted on one end thereof to the first rotary element and on an other end thereof to the at least one second contact, wherein the first and the second rotation axes are arranged substantially perpendicular to each other, wherein the second rotation axis is arranged essentially in parallel to the translational movement direction of the at least one second contact, wherein the first and the second rotary elements are configured to engage such that a rotation of the second rotary element is transmitted to the first rotary element, and wherein the link element is configured to transmit a rotational movement of the first rotary element to a translational movement of the at least one second contact.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
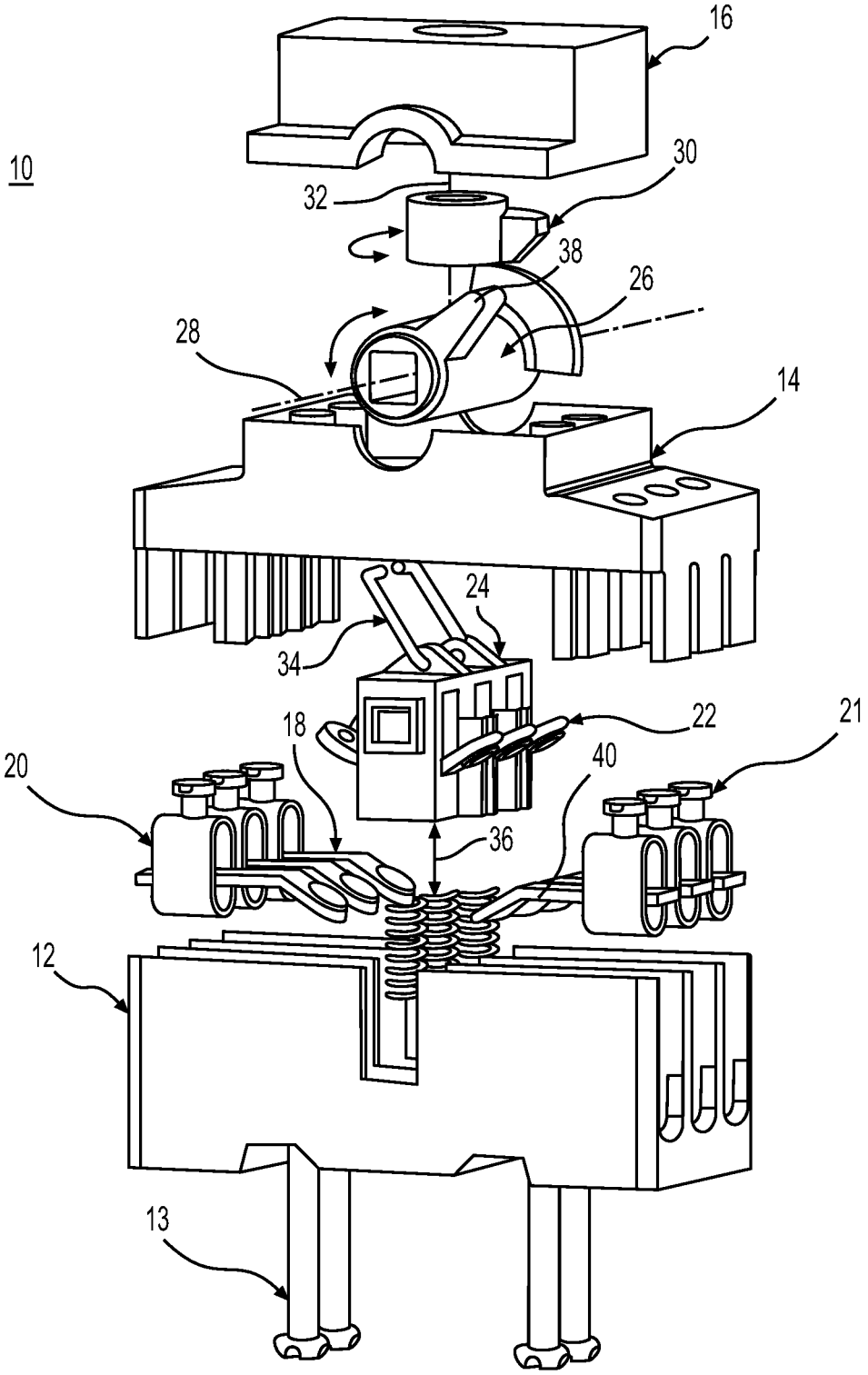
FIG. 1 shows an example of an electrical switchgear for three poles in exploded side view.

This specification describes an electrical switchgear with different modes of operation. A mode of operation determines how the switchgear can be operated, for example from the front or side in a rotary manner or by means of control element movable in a substantially translationally manner, such as a rocker switch.

According to an aspect of this specification, an electrical switchgear allowing different modes of operation is disclosed. The electrical switchgear comprises a housing, at least one first contact mounted in the housing, at least one second contact being translationally movable within the housing, a switchgear control mechanism comprising a first rotary element having a first rotation axis and a second rotary element having a second rotation axis, and a link element pivoted on its one end to the first rotary element and on its other end to the at least one second contact, wherein the first and the second rotation axes are arranged substantially perpendicular to each other, wherein the second rotation axis is arranged essentially in parallel to the translational movement direction of the at least one second contact, wherein the first and the second rotary elements engage such that a rotation of the second rotary element is transmitted to the first rotary element, and wherein the link element transmits a rotational movement of the first rotary element to a translational movement of the at least one second contact. The two rotary elements with perpendicularly arranged axes allow two different operation modes of the switch, for example from the front and from the side.

The first rotary element may comprise a lever being movable in a substantially translational manner between two end positions. With the lever, the switchgear can be operated in a toggle switch manner, i.e. in further operation mode in addition to the other two operation modes. Furthermore, the lever allows to operate the switchgear without any accessories such as handle bars or knobs.

The at least one second contact may comprise at least one contact element and a bridge element in which the at least one contact element is arranged, wherein the bridge element with the at least one contact element may be translationally movable within the housing and the at least one contact element may be translationally movable within the bridge element. The bridge element may for example serve as support and guidance for the at least one contact element, which may be particularly in case of several contact elements useful.

The length of the link element may be selected such that the bridge element can be moved further after the at least one contact element has contacted the at least one first contact.

At least one first elastic element may be arranged between the housing and the bridge element and at least one second elastic element may be arranged between the bridge element and the at least one contact element, wherein the at least one first elastic element pushes the bridge element against the link element and the at least one second elastic element pushes the at least one contact element away from the link element. The elastic elements may be for example springs, particularly compression coil springs or leaf springs or one or compliance mechanisms.

The first and the second rotary elements may be at least partly shaped as a bevel gear.

In the following, functionally similar or identical elements may have the same reference numerals. Absolute values are shown below by way of example only and should not be construed as limiting.

FIG. 1 shows an exploded view of a switchgear 10 with three different modes of operation: front and side rotary operations, and a toggle operation. The switchgear 10 is a disconnector type switch with three poles and may be adapted to be a base switch for further electrical installation equipment such as auxiliary switches. It should be however noted that the switchgear may be also implemented as a connector type switch and/or with a different number of poles, for example with one, two, or even more than three poles.

The switchgear 10 comprises a housing having a bottom housing part 12, a top housing part 14 and a cover housing part 16. The parts 12, 14, and 16 may be made of electrical insulating materials such as plastics. Screws 13 may be used to fix the assembly of the housing parts 12, 14, 16.

Fixed contacts are fixedly mounted in the bottom housing part 12. The fixed contacts comprise pairs of contact elements 18 and box terminals 20 for each contact element 18. The box terminals 20 each comprise a clamping screw 21 for clamping an electrical wire of a pole to the respective contact element 18. The contact elements 18 are made from an electrically conductive material such as copper. The contact elements 18 of each of the three pairs are arranged opposite to each other in the bottom housing part 12.

A translationally movable contact is provided to short-circuit the oppositely arranged contact elements and close the electrical paths of the poles. The movable contact comprises bridge element 24 and three contact elements 22 arranged in the bridge element 24. The bridge elements 24 serves as a holder and a guidance for the contact elements 22. The contact elements 22 are spring-loaded mounted in guides of the bridge element 24 such that the contact elements 22 are pushed downwards. A spring 40 is arranged between the bridge element 24 and the bottom housing part 12 pushing the bridge element 24 with the contact elements 22 upwards.

A mechanism for operating the switchgear 10 comprises a side rotary operation element 26 (operation around rotation axis 28) and a front rotary operation element 30 (operation around axis 32). The side rotary operation element 26 is seated in a respective support of the top housing part 14. The front rotary operation element 30 is seated in the cover housing part 16. Both rotary operation elements 26 and 30 are at least partly shaped as a bevel gear and engage in each other so that a rotation of the front rotary operation element 30 is transmitted to the side rotary operation element 26. The side rotary operation element 26 also comprises a lever 38 for a toggle operation of the switchgear 10. The lever 38 can be in a substantially translational manner between two end positions, which may be defined by respective stops in the top housing element 14.

A rotational movement of the side rotary operation element 26 is transmitted to a translational movement of the bridge element 24 and the contact elements 22 by means of a link element 34. The link element 34 is a rigid element and may be a kind of metal bracket. The link element 34 has two ends, and its one end is pivoted to the side rotary operation element 26 and its other end is pivoted to the bridge element 24. Thus, the link element 34 is rotatable around its pivoted end so that a rotation of the side rotary operation element 26 cause the link element 34 to move upwards or downwards depending of the rotary direction: when the side rotary operation element 26 is rotated counter-clockwise around its rotation axis 28, the link element 34 is pulled upwards, and the bridge element 24 pivoted to the link elements 34 is also pulled upwards in a translational movement. A clockwise rotation of the side rotary operation element 26 around its axis 28 pushes the link element 34 downwards, which also pushes the bridge element 24 downwards in a translational movement against the force of the springs 40.

The length of the link element 34 may be selected such the a clockwise rotation of the side rotary operation element 26 to close the contacts of the switchgear 10 moves the bridge element 24 over a distance, which is farther than the distance required for closing the contacts 18 and 22 so that the tension of the springs 40 allows to quickly open the contacts 18 and 22 when the switchgear 10 is operated for contact opening, for example by rotating the side rotary operation element 26 counter-clockwise.

Figure 2:
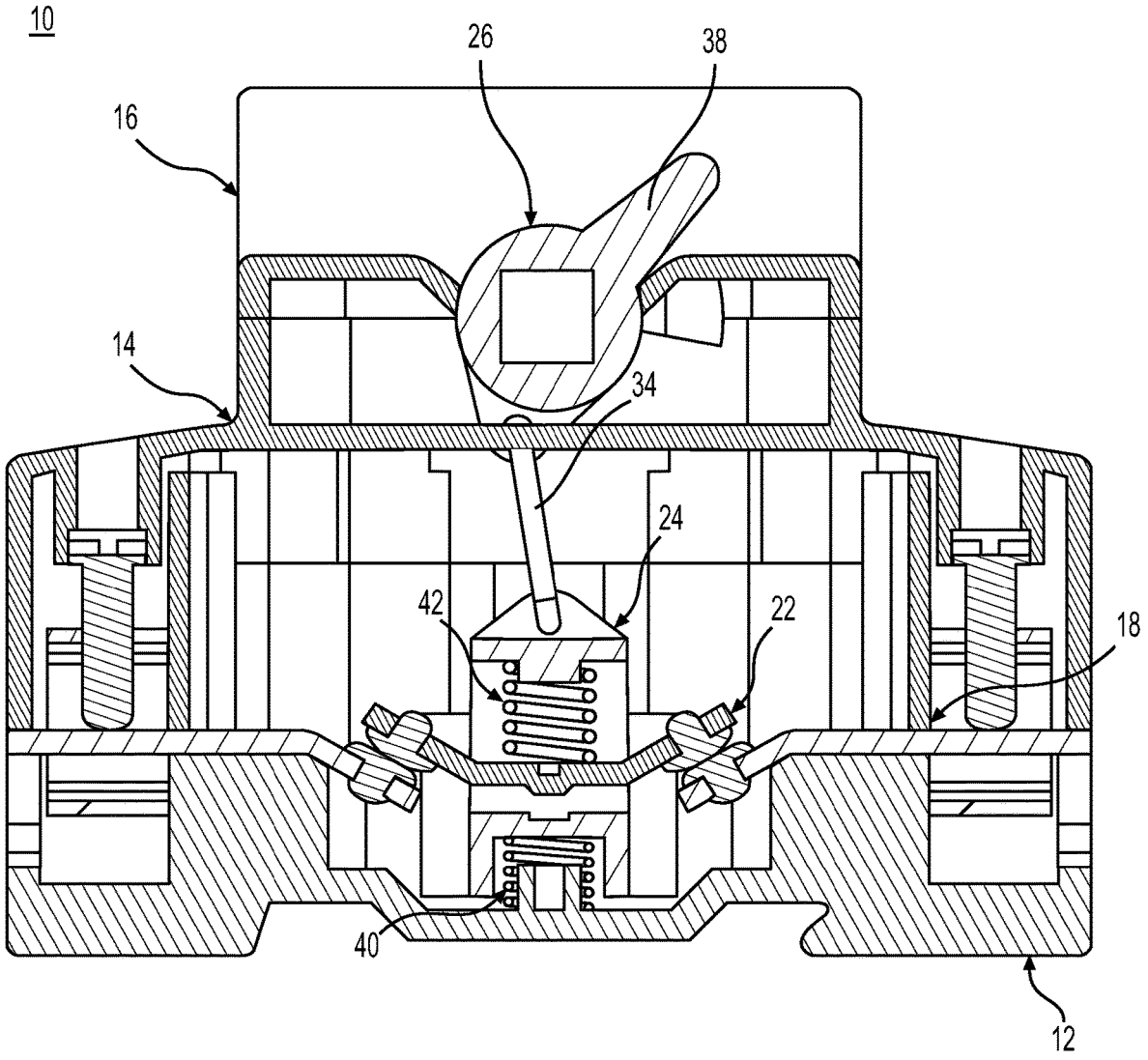
FIG. 2 shows the electrical switchgear with open contacts in a cross-sectional view.
Figure 3:
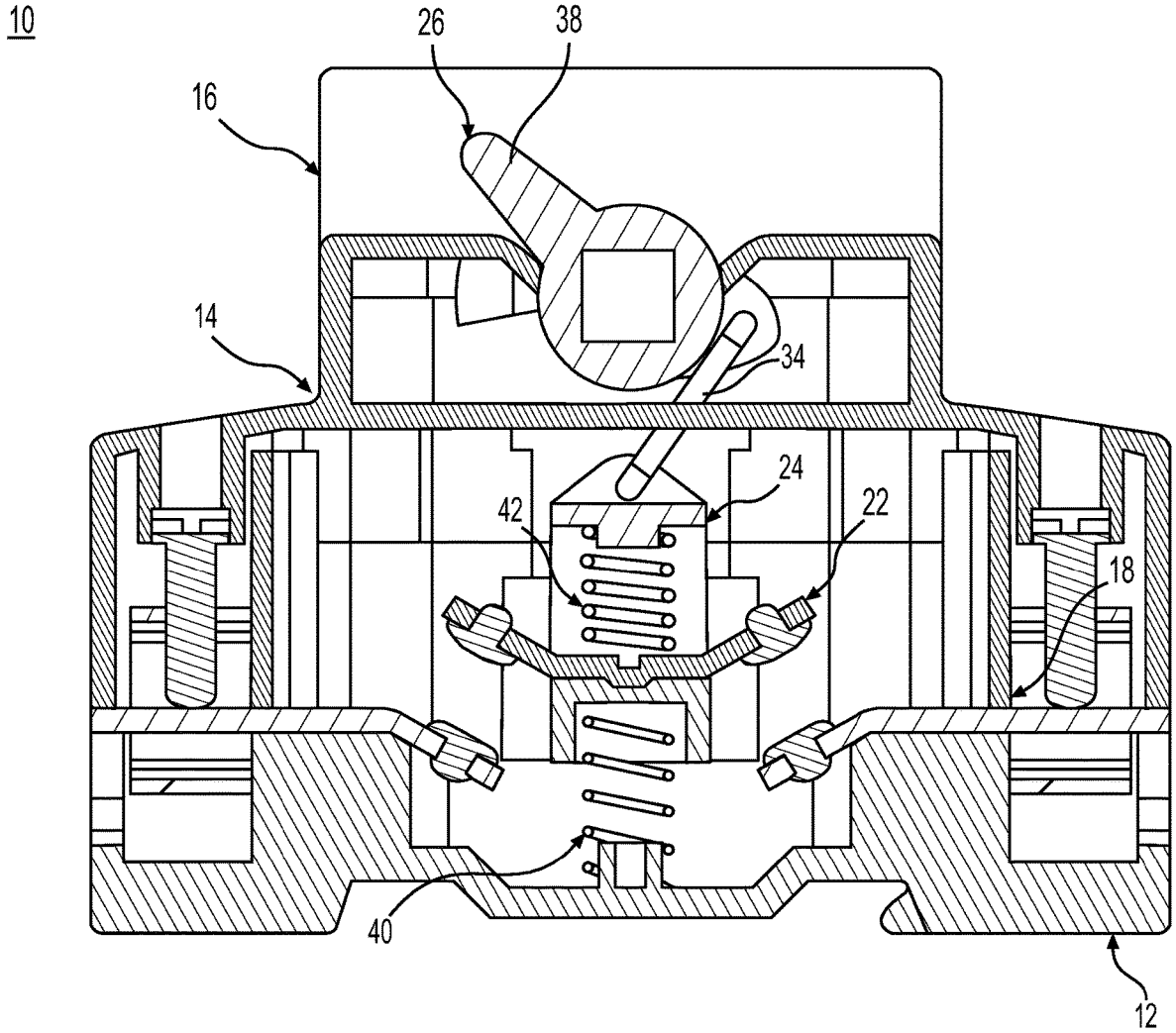
FIG. 3 shows the electrical switchgear with closed contacts in a cross-sectional view.

FIG. 2 shows a cross-sectional side view of the switchgear 10 with the contact 18, 22 in an open state (the lever 38 is moved to the downward, thus, the side rotary operation element 26 is turned counter-clockwise and the bridge element 24 is moved in an upward position). This view shows the arrangement of the springs 40 and 42: the springs 40 are arranged between the bridge element 24 and respective spring supports on the bottom of the bottom housing part 12. The springs 40 are pressure springs, which are compressed by the bridge element 24, when the bridge element 24 is translationally moved in a downward direction to the bottom of the bottom housing part 12, which is the case when the contacts 18 and 22 should be closed (as shown in FIG. 3). For each contact element 22, a respective spring 40 can be provided. However, it also possible that less or more springs 40 are provided. The springs 42 are arranged between a respective support in the bridge element 24 and a respective contact element 22. For each contact element 22 arranged in the bridge element 24, a respective spring 42 may be provided. However, it also possible that less or more springs 42 are provided. The springs 42 are pressure springs, which are compressed by the contact elements 22, when the bridge element 24 is translationally moved in a downward direction to the bottom of the bottom housing part 12 and the contacts 18 and 22 are closed, i.e. the contacts 22 are pressed on the contacts 18 (as shown in FIG. 3).

FIG. 3 shows a cross-sectional side view of the switchgear 10 with the contact 18, 22 in a closed state (the lever 38 is moved to the upward, thus, the side rotary operation element 26 is turned clockwise and the bridge element 24 is moved by the link element 34 in a downward position). The bridge element 24 is in this state of the switchgear 10 moved downwards compressing the spring 40; the contacts 22 are pressed by the compressed spring 42 on the contacts 18, thus, ensuring a reliable contacting). When the contacts should be opened from this state, the side rotatory operation element 26 or the front rotary operation element (not shown in FIGS. 2, 3) must be rotated counter clockwise or the lever 38 must be moved to the downward. Then, the link element 34 is pulled by the counter-clockwise rotating element 26 upwards, and the bridge element 24 is also moved upwards together with the rigid link element 34. The upward movement of the bridge element 24 is supported by both springs 40 and 42, which accelerates the movement and results in a relatively quick opening of the contacts 18, 22.

Figure 4:
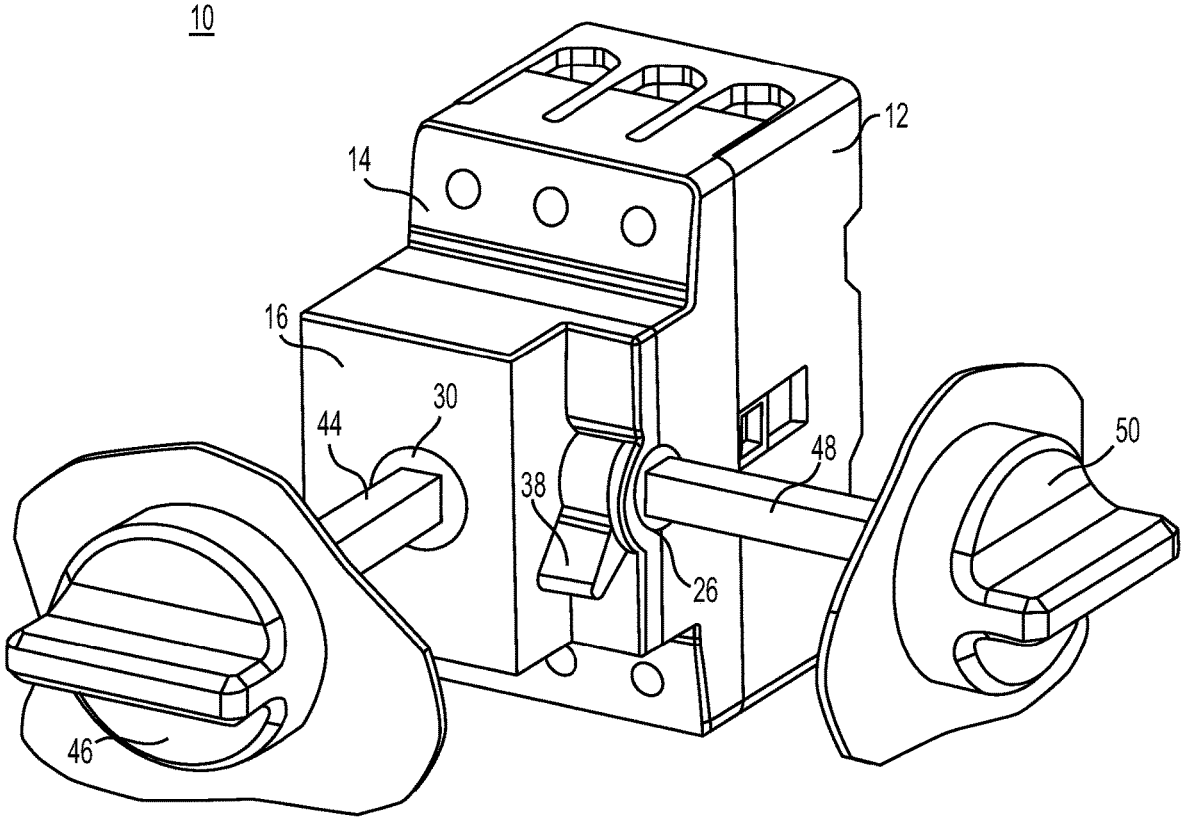
FIG. 4 shows the electrical switchgear in a perspective view with handle bars for front and side operation.

FIG. 4 shows the electrical switchgear 10 in a perspective view with mounted handle bars for front and side operation. The handle bar 44 is provided for front operation and the handle bar 48 is provided for side operation. Each handle bar 44, 48 comprises a control dial 46, 50 for manually rotating the handle bar 44, 48 by an operator. Both handle bars 44, 48 are four-cornered shafts dimensioned to be inserted in respective openings front and side rotary operation elements 30, 26. Generally, the handle bars 44, 48 and the respective openings for mounting them in the elements 26, 30 are designed such that a rotation of the respective handle bar incurs also a rotation of the respective element. At the free ends of the handle bars 44, 48 the control dials 46, 50 are fixed in order to allow an operation to rotate the respective handle bar. The handle bars 44, 48 with the control dials 46, 50 enable a front and a side operation of the switchgear 10. Typically, only one of the handle bars is mounted in the switchgear depending on the mounting of the switchgear for example in an electrical switchgear cabinet. However, also both handle bars can be mounted if the mounting position of the switchgears allows this, and a front and side operation with control dials should be made possible. A further third operation mode is implemented by the lever 38.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An electrical switchgear, comprising:

a housing;

at least one first contact mounted in the housing;

at least one second contact translationally movable within the housing in a translational movement direction;

a switchgear control mechanism comprising a first rotary element having a first rotation axis and a second rotary element having a second rotation axis; and a link element pivoted on one end thereof to the first rotary element and on an other end thereof to the at least one second contact, wherein the first and the second rotation axes are arranged substantially perpendicular to each other, wherein the second rotation axis is arranged essentially in parallel to the translational movement direction of the at least one second contact, wherein the first and the second rotary elements are configured to engage such that a rotation of the second rotary element is transmitted to the first rotary element, and wherein the link element is configured to transmit a rotational movement of the first rotary element to a translational movement of the at least one second contact.

2. The electrical switchgear of claim 1, wherein the first rotary element comprises a lever movable in a substantially translational manner between two end positions.

3. The electrical switchgear of claim 1, wherein the at least one second contact comprises at least one contact element and a bridge element in which the at least one contact element is arranged, and wherein the bridge element with the at least one contact element is translationally movable within the housing and the at least one contact element is translationally movable within the bridge element.

4. The electrical switchgear of claim 1, wherein the first rotary element and the second rotary element are at least partly shaped as a bevel gear.

5. An electrical switchgear, comprising:

a housing;

at least one first contact mounted in the housing;

at least one second contact translationally movable within the housing in a translational movement direction;

a switchgear control mechanism comprising a first rotary element having a first rotation axis and a second rotary element having a second rotation axis; and a link element pivoted on one end thereof to the first rotary element and on an other end thereof to the at least one second contact, wherein the first and the second rotation axes are arranged substantially perpendicular to each other, wherein the second rotation axis is arranged essentially in parallel to the translational movement direction of the at least one second contact, wherein the first and the second rotary elements are configured to engage such that a rotation of the second rotary element is transmitted to the first rotary element, wherein the link element is configured to transmit a rotational movement of the first rotary element to a translational movement of the at least one second contact, wherein the at least one second contact comprises at least one contact element and a bridge element in which the at least one contact element is arranged, wherein the bridge element with the at least one contact element is translationally movable within the housing and the at least one contact element is translationally movable within the bridge element, and wherein a length of the link element is such that the bridge element is configured to be moved farther after the at least one contact element has contacted the at least one first contact.

6. An electrical switchgear, comprising:

a housing;

at least one first contact mounted in the housing;

at least one second contact translationally movable within the housing in a translational movement direction;

a switchgear control mechanism comprising a first rotary element having a first rotation axis and a second rotary element having a second rotation axis; and a link element pivoted on one end thereof to the first rotary element and on an other end thereof to the at least one second contact, wherein the first and the second rotation axes are arranged substantially perpendicular to each other, wherein the second rotation axis is arranged essentially in parallel to the translational movement direction of the at least one second contact, wherein the first and the second rotary elements are configured to engage such that a rotation of the second rotary element is transmitted to the first rotary element, wherein the link element is configured to transmit a rotational movement of the first rotary element to a translational movement of the at least one second contact, wherein the at least one second contact comprises at least one contact element and a bridge element in which the at least one contact element is arranged, wherein the bridge element with the at least one contact element is translationally movable within the housing and the at least one contact element is translationally movable within the bridge element, wherein at least one first elastic element is arranged between the housing and the bridge element and at least one second elastic element is arranged between the bridge element and the at least one contact element, and wherein the at least one first elastic element is configured to push the bridge element upward against the link element and the at least one second elastic element is configured to push the at least one contact element downward away from the link element.

* * * * *